US009174349B2

(12) United States Patent
Schmitt

(10) Patent No.: US 9,174,349 B2
(45) Date of Patent: Nov. 3, 2015

(54) ROTARY ELECTRIC SHAVER

(71) Applicant: Rovcal, LLC, Madison, WI (US)

(72) Inventor: Paul Allen Schmitt, Madison, WI (US)

(73) Assignee: Spectrum Brands, Inc., Middleton, WI (US)

( * ) Notice: Subject to any disclaimer, the term of this patent is extended or adjusted under 35 U.S.C. 154(b) by 351 days.

(21) Appl. No.: 13/739,439

(22) Filed: Jan. 11, 2013

(65) Prior Publication Data

US 2014/0196292 A1 Jul. 17, 2014

(51) Int. Cl.

| | |
|---|---|
| ***B26B 19/14*** | (2006.01) |
| ***B26B 19/28*** | (2006.01) |
| ***B26B 19/38*** | (2006.01) |

(52) U.S. Cl.

CPC ..... *B26B 19/14* (2013.01); *B26B 19/146* (2013.01); *B26B 19/28* (2013.01); *B26B 19/3893* (2013.01); *Y10T 29/49002* (2015.01)

(58) Field of Classification Search

CPC ..... B26B 19/12; B26B 19/386; B26B 19/14; B26B 19/146; B26B 19/28; B26B 19/3893; Y10T 29/49002

See application file for complete search history.

(56) References Cited

U.S. PATENT DOCUMENTS

| | | | |
|---|---|---|---|
| 2,021,241 | A | 11/1935 | Mall |
| 2,129,559 | A | 9/1938 | Blackwell |
| 2,183,442 | A | 12/1939 | Blackwell |
| 2,253,037 | A | 8/1941 | Knapp |
| 2,253,737 | A | 8/1941 | Testi |
| 2,280,052 | A | 4/1942 | Bahr |
| 2,292,931 | A | 8/1942 | Dicke |
| 2,359,880 | A | 10/1944 | Scully |
| 2,416,776 | A | 3/1947 | Schlotthauer |
| 2,462,625 | A | 2/1949 | Florman |
| 2,659,139 | A | 11/1953 | Davison |
| 2,677,884 | A | 5/1954 | Richard |
| 2,841,806 | A | 7/1958 | Blasi |
| 2,878,499 | A | 3/1959 | Pressman |
| 2,933,809 | A | 4/1960 | McWilliams |
| 3,143,797 | A | 8/1964 | Shoemaker |
| 3,183,538 | A | 5/1965 | Hubner |
| 3,314,696 | A | 4/1967 | Ferguson et al. |
| 3,753,582 | A | 8/1973 | Graham |

(Continued)

FOREIGN PATENT DOCUMENTS

| | | | |
|---|---|---|---|
| EP | 0176128 | A1 | 4/1986 |
| EP | 0197572 | A1 | 10/1986 |

(Continued)

OTHER PUBLICATIONS

International Search Report and Written Opinion for PCT/US2014/011032, dated Apr. 8, 2014, 86 pages.

(Continued)

*Primary Examiner* — Hwei C Payer
(74) *Attorney, Agent, or Firm* — Armstrong Teasdale LLP

(57) ABSTRACT

A rotary electric shaver includes a handle assembly having a housing, a motor disposed in the housing, a drive shaft operatively connected to the motor and extending through the housing, and a socket for securing a shaver head thereto. The shaver head assembly includes a coupling for detachable coupling to the socket. The coupling is configured to allow the shaver head to be detachably coupled to the handle assembly in at least two different orientations of the shaver head relative to the handle assembly.

18 Claims, 7 Drawing Sheets

(56) References Cited

U.S. PATENT DOCUMENTS

| | | | | |
|---|---|---|---|---|
| 4,635,974 | A | 1/1987 | Moussaian | |
| 5,000,614 | A | 3/1991 | Walker et al. | |
| 5,007,168 | A | 4/1991 | Messinger et al. | |
| 5,544,415 | A * | 8/1996 | Huang | 30/43.92 |
| 5,606,799 | A | 3/1997 | Melton | |
| 6,076,263 | A * | 6/2000 | Andis et al. | 30/216 |
| 6,886,255 | B2 * | 5/2005 | Freas et al. | 30/43.91 |
| 8,261,452 | B2 | 9/2012 | Westerhof et al. | |
| 8,393,082 | B2 * | 3/2013 | Shimizu | 30/43.6 |
| 2004/0068873 | A1 | 4/2004 | Tona | |
| 2010/0018058 | A1 * | 1/2010 | Brada et al. | 30/43.6 |
| 2010/0058594 | A1 | 3/2010 | Westerhof et al. | |
| 2010/0287784 | A1 * | 11/2010 | Qiu | 30/527 |
| 2014/0196292 | A1 * | 7/2014 | Schmitt | 30/41.6 |
| 2014/0352152 | A1 * | 12/2014 | Shimizu | 30/43.6 |

FOREIGN PATENT DOCUMENTS

| | | | |
|---|---|---|---|
| EP | 2281670 | A1 | 2/2011 |
| EP | 2086729 | B1 | 5/2012 |
| GB | 1450888 | | 9/1976 |
| JP | 61-012485 | U | 1/1986 |
| JP | 61-012486 | U | 1/1986 |
| JP | 61-012487 | U | 1/1986 |
| JP | 61-012488 | U | 1/1986 |
| JP | 02-241477 | | 9/1990 |
| JP | 02-299684 | | 12/1990 |
| JP | 03-268784 | | 11/1991 |
| JP | 05-088477 | U | 12/1993 |
| JP | 06-068675 | U | 9/1994 |
| JP | 06-072565 | U | 10/1994 |
| JP | 08-126778 | | 5/1996 |
| JP | 2000-300871 | | 10/2000 |
| KR | 2002-071549 | | 9/2002 |
| WO | 2005030002 | A1 | 4/2005 |
| WO | 2006067710 | A1 | 6/2006 |
| WO | 2006067713 | A1 | 6/2006 |
| WO | 2006067721 | A1 | 6/2006 |
| WO | 2008010139 | A1 | 1/2008 |
| WO | 2008062339 | A1 | 5/2008 |
| WO | 2010103425 | A1 | 9/2010 |

OTHER PUBLICATIONS

International Preliminary Report on Patentability, PCT/US2014/011032 mailed Jul. 23, 2015, 6 pages.

* cited by examiner

ROTARY ELECTRIC SHAVER

FIELD

The field of the present disclosure relates generally to electric shavers, and more particularly to rotary electric shavers including a detachable shaving head.

BACKGROUND

Rotary electric shavers conventionally include a handle and a head releasably attached to the handle and carrying two or more sets of paired inner and outer cutter blades. The outer cutter blades, which are typically circular in shape, are supported by a frame of the shaver head and typically define the skin contacting surface of the shaver along with the outer surface of the shaver head. Openings or slots formed in the outer cutter allow hair to protrude through the outer cutter below an inner surface thereof as the shaver is moved over a user's skin. Inner cutter blades are housed in the shaver head below the outer cutter in sliding engagement with the inner surface of the outer cutter. The inner cutter blades are rotatably driven by an electric motor, typically housed within the handle, whereby rotation of the inner cutter acts to cut hairs protruding inward through the outer cutter.

In current rotary electric shaver constructions, the frame and the outer cutters together define the outer skin-facing or skin-contacting surface of the shaver, with the outer cutters each extending individually outward of the frame. However, when shaving with a rotary shaver, the outer cutters must pass over the user's various skin contours. The transition of the outer cutter over the skin surface is thus often not smooth and can be abrupt. The smoother the transition is over the entire skin-facing outer surface of the shaver head (e.g., from the frame to the outer surface of the outer cutter), the more comfortable the shaving experience will be.

With this current construction, as the shaver is moved over the user's face the skin is forced up over the edges of the outer cutters. This action can cause the skin to drag, or become pinched, and the shaver does not glide smoothly onto the top surface of the outer cutter.

Additionally, some shavers may incorporate a shaving head that is attached only at a center of the shaving head. However, due to the small attachment point, the shaving head is susceptible to damage if dropped. For example, if dropped, the attachment mechanism between the shaver body and shaving head may break, causing the shaving head to break off from the shaving body and render the shaver unusable.

There is a need, therefore, for a reduced bulk rotary electric shaver that facilitates a smoother, more comfortable shave and allows for the shaving head to safely decouple from the body.

SUMMARY

In one aspect, a rotary electric shaver includes a handle assembly having a housing, a motor disposed in the housing, a drive shaft operatively connected to the motor and extending through the housing, and a socket for securing a shaver head thereto. The shaver head assembly includes a coupling for detachable coupling to the socket. The coupling is configured to allow the shaver head to be detachably coupled to the handle assembly in at least two different orientations of the shaver head relative to the handle assembly.

In another aspect, a detachable shaver head assembly for a rotary electric shaver is disclosed. The rotary electric shaver has a handle including a housing, a motor, and a drive shaft accessible by the shaver head assembly exterior of the housing. The shaver head assembly is positionable on the handle assembly and includes a coupling for detachable coupling to a complimentary socket of the handle. The coupling is configured to allow the shaver head to be detachably coupled to the handle assembly in at least two different orientations of the shaver head with respect to the handle assembly.

In yet another aspect, a method of positioning a detachable shaver head on an rotary electric shaver handle is disclosed. The rotary electric shaver has a handle including a housing, a motor, and a drive shaft accessible by the shaver head assembly exterior of the housing. A coupling of the shaver head is aligned with a complimentary socket of the handle. The coupling is configured for aligning with the socket in at least two different orientations of the shaver head with respect to the handle. The coupling is pressed to the socket such that the coupling is detachably coupled to the socket. The drive shaft engages with a drive coupling of the shaver head.

BRIEF DESCRIPTION OF THE DRAWINGS

Unless otherwise indicated, corresponding reference characters indicate corresponding parts throughout the several views of the drawings.

DETAILED DESCRIPTION

Figure 1:
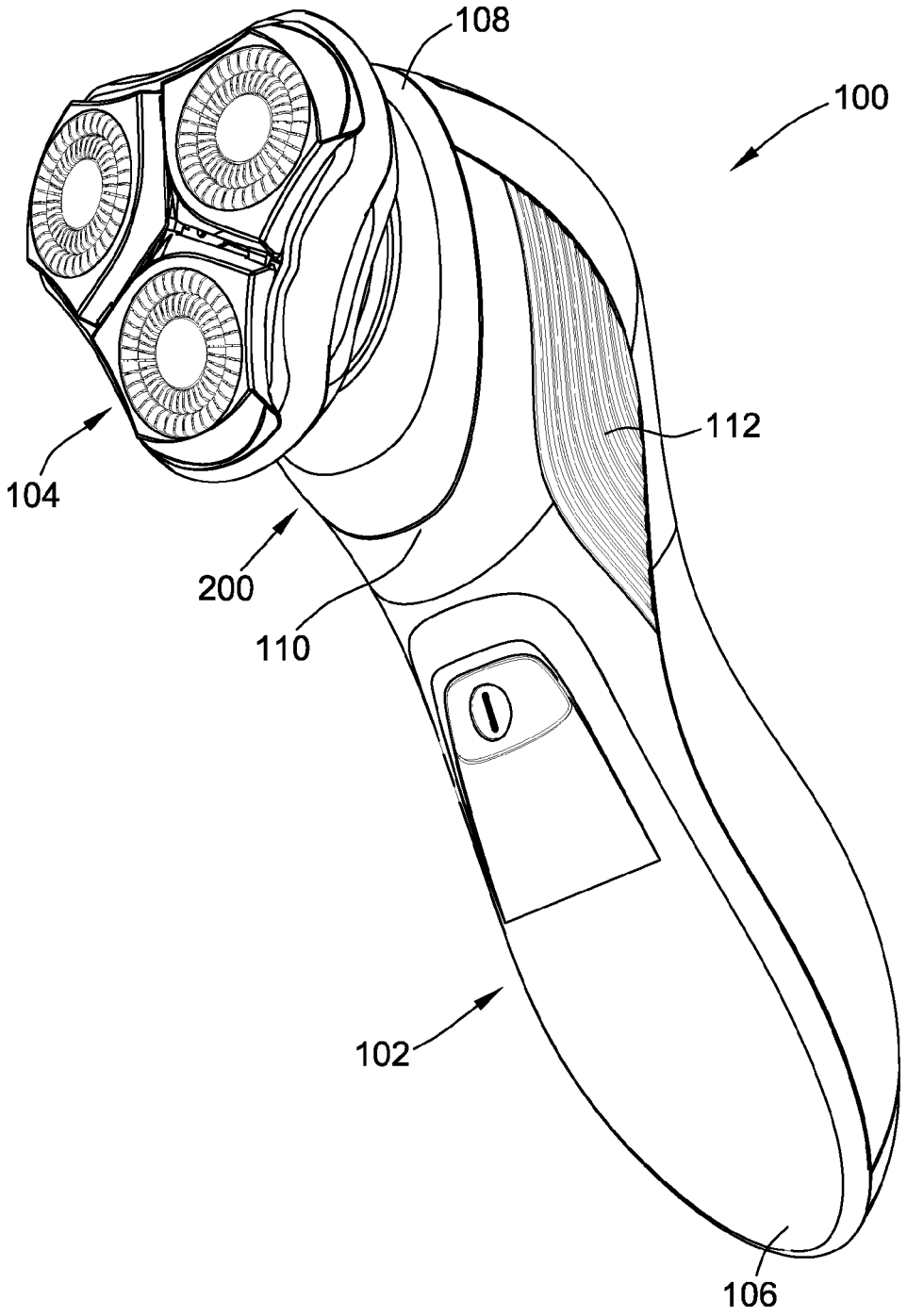
FIG. 1 is a perspective view of one embodiment of a rotary shaver.

Referring now to the drawings, and in particular to FIG. 1, a rotary shaver according to one embodiment is indicated generally by the reference numeral 100. In the illustrated embodiment, the shaver 100 comprises a handle assembly 102 and a detachable shaver head assembly 104 mounted on the handle assembly 102. The handle assembly 102 has a first or distal end 106, a second or proximal end 108, and a hollow housing 110 extending from the first end 106 to the second end 108, such that a battery, a motor, and gearing may be housed within the handle assembly 102. The handle assembly 102 may include a grip 112 including ridges, indentations or surface roughness to enhance the users grip on the handle. Suitably, the handle assembly 102 has a head assembly mount 200 near the second end 108 for detachably coupling shaver head 104 to the handle 102. It is also contemplated that the handle assembly 102 may house any suitable operational components of the shaver 100 without departing from the scope of this disclosure.

Figure 5:
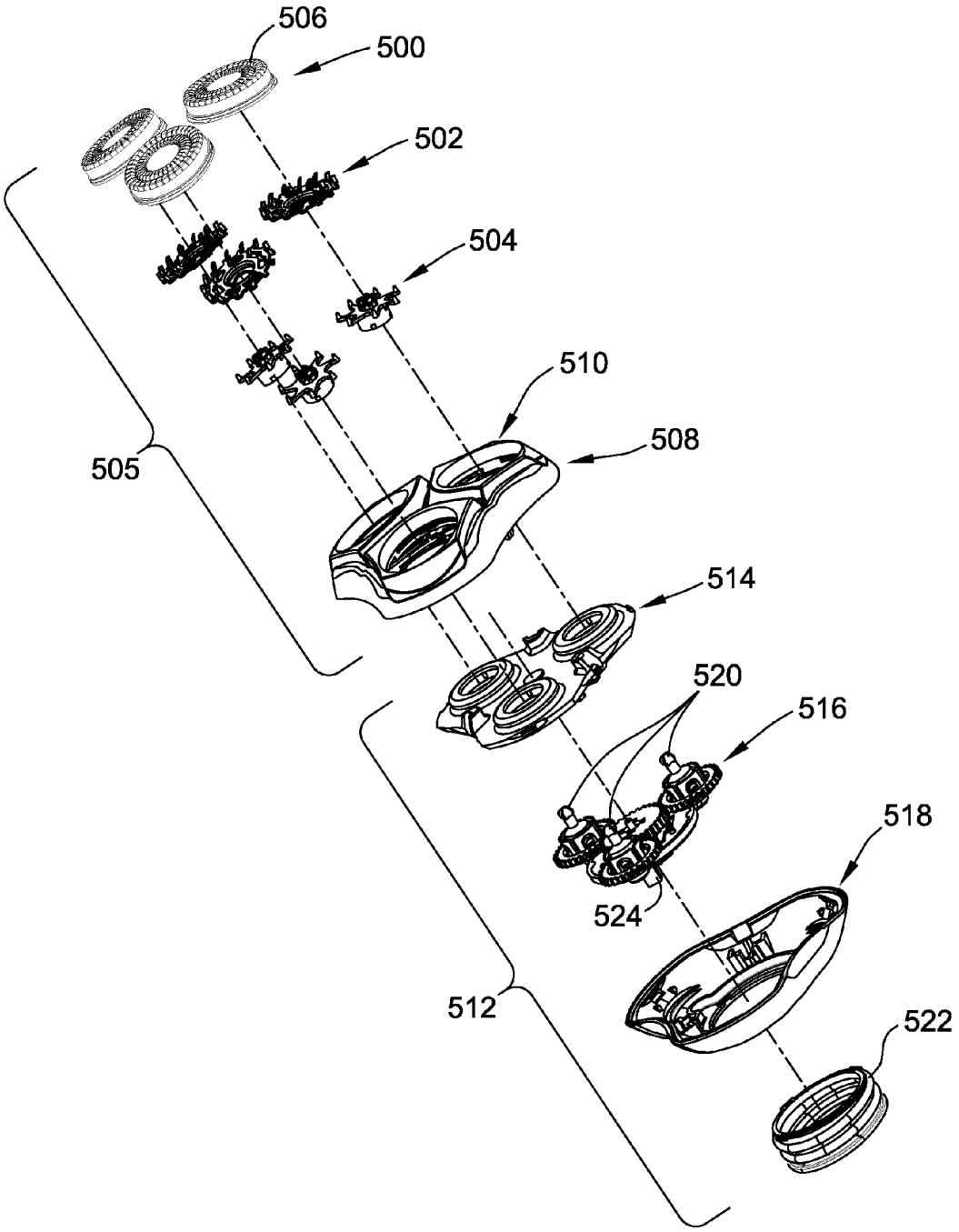
FIG. 5 is an exploded view of the shaver head.

As best shown in FIG. 5, one exemplary shaver head assembly 104 includes an upper cutter portion 505 and a lower base section 512. The upper cutter portion 505 includes a set of outer cutters 500, and one or more sets of inner cutters 502, 504. The outer cutters 500 include a plurality of slots extending through a hair contacting surface 506 for allowing hairs to enter therethrough. Opposite to the hair contacting surface 506, the outer cutters define an annular groove configured for at least partially housing the inner cutters 502, 504. The inner cutters 502, 504 are configured for rotational engagement with the plurality of slots, such that hairs entering through the slots are cut between the inner cutters 502, 504 and the outer cutters 506. The inner cutters 502, 504 and the outer cutters 506 are supported by a blade carrier 508, which is removably coupleable to lower housing 518. The blade carrier 508 includes a skin contacting surface 510 adjacent to the hair contacting surface 506 of the outer cutters 500, when the rotary shaver 100 is fully assembled, for example as shown in FIG. 1. The upper cutter section 505 is detachable from the lower base section 512, for example for cleaning.

The lower base section 512 includes an intermediate wall 514, a drive gear set 516, and a lower housing 518. When assembled, the open space between the blade carrier 508 and the intermediate wall 514 defines a hair pocket 222 (shown in FIG. 2) for collecting hair clippings. The drive gear set 516 includes a plurality of drive shafts 520 that extend through the intermediate wall 514 for rotational engagement with the inner cutters 502, 504, for rotationally driving the inner cutters.

A flexible sleeve 522 may be provided between the lower base section 512 and the handle assembly 102. In embodiments, the flexible sleeve 522 may provide protection for coupling 202 and may provide a spring action for biasing the shaver head 104 in a predetermined position.

Figure 2:
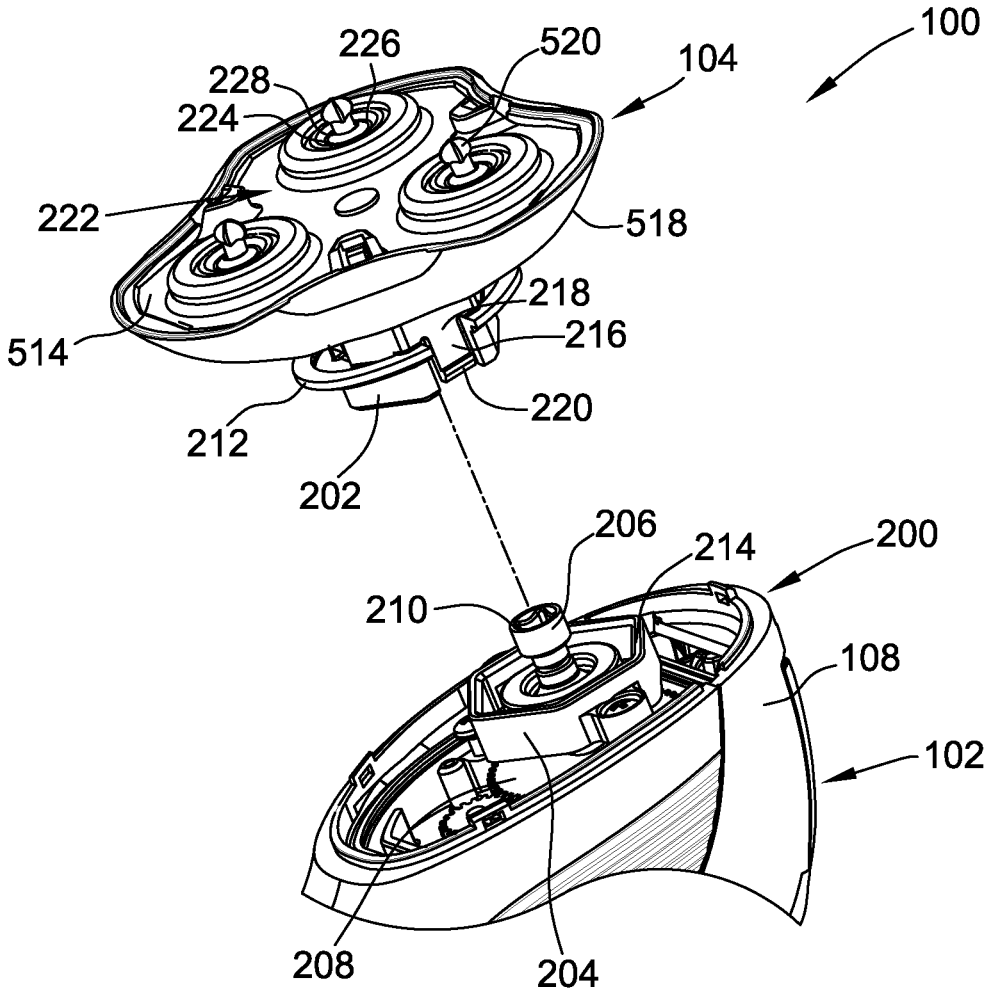
FIG. 2 is a perspective view of the rotary shaver of FIG. 1 with the shaver head detached.
Figure 3:
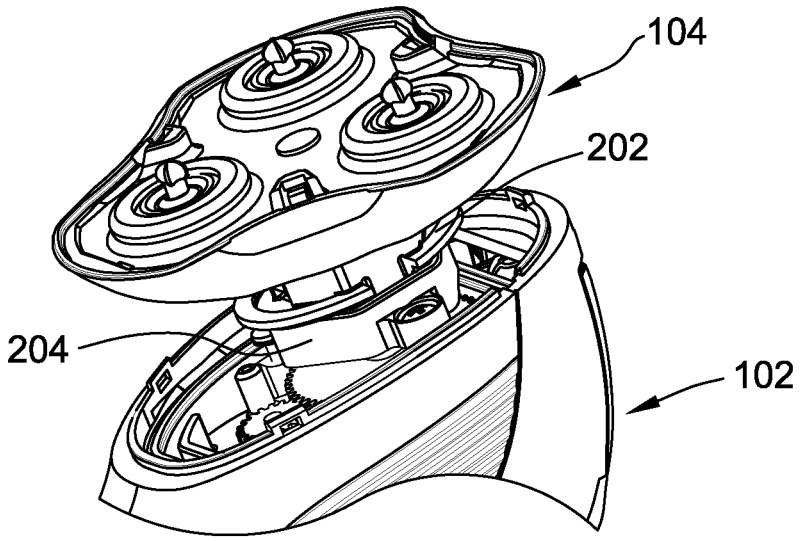
FIG. 3 is a perspective view of the rotary shaver of FIG. 1 with the shaver head attached.

As shown in FIG. 2, the shaver head assembly 104 includes a coupling 202 that allows for detachable coupling to a socket 204 of the handle 102. FIG. 2 illustrates the shaver head 104 detached from handle assembly 102. FIG. 3 illustrates the shaver head assembly 104 attached to the handle assembly 102.

Figure 6:
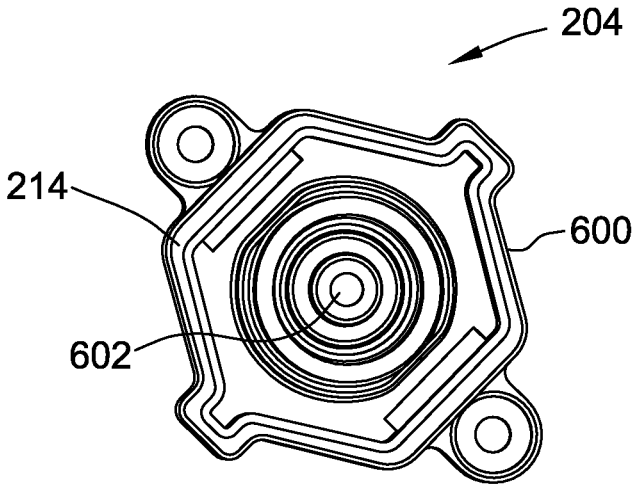
FIG. 6 is a plan view of a socket of the rotary shaver.
Figure 7:
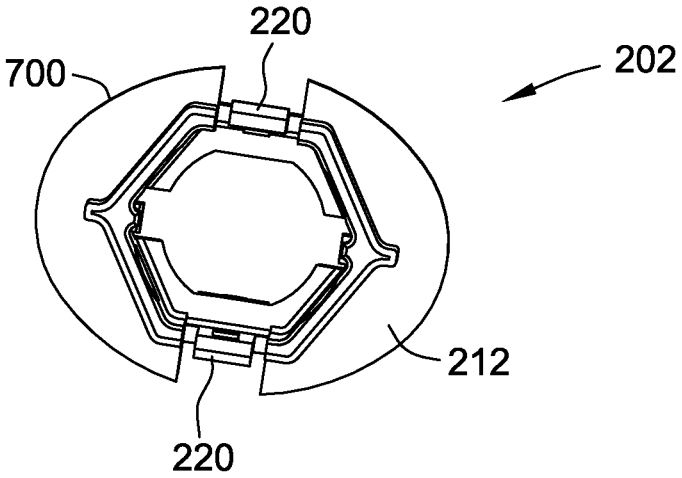
FIG. 7 is a plan view of a coupling of the rotary shaver.

The coupling 202 and the socket 204 are configured to have complimentary shapes, such that the coupling 202 fits into the socket 204 in at least two different orientations. The complimentary shapes of the socket 204 and the coupling 202 are best seen in FIGS. 6 and 7, which illustrate a top view of the socket 204 and a bottom view of the coupling 202, respectively. Such configuration may be referred to as a "keyed coupling and keyed socket," because like a key, the shape of the coupling 202 matches a corresponding shape of the socket in certain orientations. For example, in the embodiment of FIG. 2 (and FIGS. 6 and 7), the coupling 202 and socket 204 each have a hexagonal cross section (i.e., when viewed along a central axis defined by the driveshaft 206), allowing the shaver head 202 to attach to the socket in at least two positions, for example in increments of 60 degrees, such as 180 degrees. For example, one position may be the orientation shown in FIGS. 1-3, wherein two of the cutters are positioned proximate the second end 108, and a single cutter faces the first end 106. Alternatively, the shaver head 104 may be rotated 180 degrees, such that the single cutter is proximate the second end 108 and two of the cutters face the first end 106.

Although the coupling 202 and socket 204 are shown including a hexagonal cross-sectional shape, any suitable cross sectional shape, such as triangular, round, octagonal, rectangular, oval, other geometric shapes or the like may be used that allow the shaver 100 to function as described herein.

As best seen in FIG. 2, the socket 204 may include a driveshaft 206 extending through a bore 602 (FIG. 6). Driveshaft 206 is coupled to a drive motor (not shown), by way of a gear 208 on a side thereof proximate the handle 102. The other end of the driveshaft 206 that is proximal to the shaver head 104 (distal to the handle 102) includes a drive coupling 210 for driving the inner cutters 502, 504 (FIG. 5). The drive coupling is configured for a rotatable connection to the drive gear set 516 by way of a drive pin 524 that connects to the drive coupling 210.

The coupling 202 is configured to be press-fit into the socket 204, as shown in FIG. 3. As used herein, the term "press-fit" refers to the coupling being at least partially inserted into the socket 204. Press-fitting may also include a snap-fit, friction-fit, or the like between the socket 204 and the coupling 202. As used herein, the term "snap-fit" refers to a type of coupling that may provide an audible click, or snapping noise, when the coupling 202 is fully secured to the socket 204. However, it should be understood that it is not necessary that the user hear the click for the coupling 202 to be fully secured to the socket 204. The coupling may include a stop 212 for limiting the extent to which the coupling may be fit into the socket 204. In this regard, the stop 212 has an outer perimeter 700 (FIG. 7) that extends beyond the outer perimeter 600 (FIG. 6) of the socket 204, such that the stop 212 abuts surface 214 of socket 204 when the coupling 202 is fully inserted into the socket 204.

Figure 4:
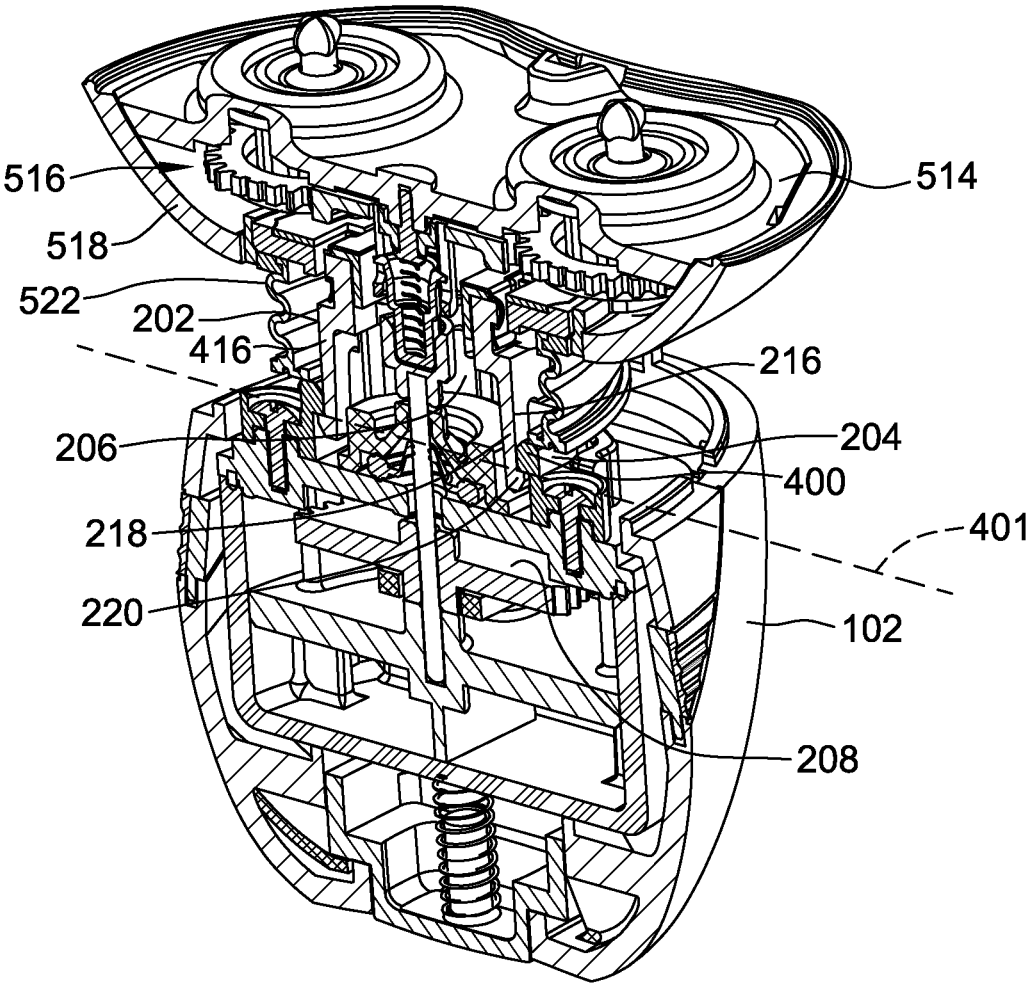
FIG. 4 is a section view of the shaver of FIG. 1.

In some embodiments, for example as seen in FIGS. 2 and 6-7, the coupling 202 includes a clip 216 that includes a spring arm 218 and a lug 220 extending therefrom. The clip 216 is configured for releasable engagement with socket 204. For example, as shown in FIG. 4, the clip 216 is at least partially fitted within socket 204. The lug 220 is configured for releasable engagement along an engagement plane 401 with a detent 400 defined by a portion of socket 204. The spring arm 218 may be configured to bias the lug 220 outwardly with adequate pressure, such that the lug 220 does not release during normal use of the shaver 100. In addition, the spring arm 218 is flexible such that upon inserting the clip 216 into the socket 204, the spring arm 218 flexes to allow the lug 220 to pass by the surface 214. In a similar manner, for removal of the shaver head 104 from the handle assembly 102, the spring arm 218 may be flexed radially inwardly until the lug 220 clears the detent 400, which allows the coupling 202 to be pulled out of the socket 204.

In addition, for improved resistance to damage, the clip 216 is configured to release if sufficient force is applied between the shaver head 104 and the handle 102. For example, in one suitable embodiment, the flexibility of the spring arm 218 is sufficient such that if the shaver 100 is dropped, for example causing the shaver head to strike a surface obliquely, the spring arm 218 will flex to the extent necessary to release the shaver head 104 from the handle 102, thus allowing the shaver head 104 to detach from the handle 102, thereby reducing or eliminating damage thereto.

It is understood that two or more clips 216 may be included on shaver head 104. For example, a second clip 416 is shown in FIG. 4 opposite clip 216. It is also contemplated that any number of clips may be used that allow the shaver 100 to function as described herein.

Referring again to FIG. 2, the hair pocket 222 is defined as the space between intermediate wall 514 and blade carrier 508 (FIG. 5). The intermediate wall 514 has a plurality of shaft apertures 226 substantially equidistantly spaced about the center thereof, in a generally triangular configuration that corresponds to the arrangement of the drive shafts 520. Each shaft aperture 226 is suitably sized to receive one of the drive shafts 520 therethrough. In the embodiment shown, each shaft aperture 226 is sealed by a sealing member 224. The sealing member 224 is provided with an aperture 228 configured to allow the drive shaft 520 to rotate therethrough, but substantially seal the shaft aperture 226 such that hair clippings or other debris do not pass into the gear set 516, located therebelow. Additionally, sealing members 224 may be flexible, such that drive shafts 520 may pivot, while the sealing member retains the sealing capability. Accordingly, a user may clean, or empty, the hair pocket 222 by removing the blade carrier 508, and inverting the shaver head 104 such that the hair clippings in the hair pocket 222 fall out.

The intermediate wall 524 may be fabricated such that it is substantially smooth, allowing it to be easily cleaned by wiping or rinsing. In some embodiments, intermediate wall 514 and sealing members 224 are configured to create a substantially watertight seal with base 518. In this embodiment, if the shaver head is rinsed with a liquid such as water or a suitable cleaning solution, the liquid does not infiltrate the gear set 516 (FIG. 5).

In some embodiments, the shaver head 104 is configured for pivotal movement with respect to handle assembly 102. In such embodiments, driveshaft 206 may be configured as a universal joint or the like, such that the drive shaft 206 may pivot in two or more directions. In such embodiments, coupling 202 and/or socket 204 may be sized such that the coupling 202 fits within the socket 204, but may pivot at least to some extent therein. Suitably, in such embodiments, flexible sleeve 522 may be provided between the lower base section 512 and the handle 102 to impart a spring action for centering, or biasing, the shaver head 104 in a predetermined position. For example, if the shaver head 104 is pivoted with respect to the handle assembly 102 (e.g., when a user moves the shaver head 104 across a contoured skin surface), the flexible sleeve 522 urges the shaver head 104 back to a centered position once the shaver is no longer against the skin surface. The flexible sleeve may be fabricated from a resilient synthetic or semi-synthetic, organic-based material (e.g., a "rubber" material) to facilitate conforming the flexible sleeve to a curvature of base 518 and/or head assembly mount 200.

In one embodiment of a method of coupling a shaver head to a handle, for example in a rotary shaver such as the rotary shaver 100, the shaver head 104 is coupled to the handle 102. In this embodiment, for example as discussed above, the shaver head 104 is positioned above the handle 102, such as in the position shown in FIG. 2. The coupling 202 is aligned with the socket 204 in a desired orientation. The user then presses the coupling 202 into the socket 204 until the stop 212 abuts surface 214. At this time, the clips 216 may make a clicking sound as the lug 220 engages the detent 400, which may indicate to the user that the shaver head has been fully press-fit onto the handle. However, even if the clicking noise is not audible or does not occur, the shaver head 104 may still be fully press fit onto the handle 102. It is noted that as the user presses coupling 202 into the socket 204, the drive pin 524 connects to the drive coupling 210 to facilitate transfer of torque from the driveshaft 206 to the gearset 516, which provides driving rotation of the inner cutters 502, 504.

During an exemplary operation of the rotary shaver 100, a user grasps the handle assembly 102 and glides the outer cutters 506 over the skin such that hairs from the skin are directed into the slots of the outer cutters 506, wherein the hairs are cut via the rotating inner cutters 502, 504 and are stored in the hair pocket 222 for subsequent disposal. In some embodiments, as the outer cutters 506 glide over contours of the skin (e.g., the contours of the user's face), the outer cutters 500 and inner cutters 502, 504 are configured to float up and down on drive shafts 520 to facilitate maintaining the outer cutters 500 in contact with the skin.

To further facilitate maintaining the skin contacting surfaces 468 of the outer cutters 464 in contact with the skin when rounding contours of the skin, the shaver head 104 may be configured to float up and down with respect to the handle 102. In this embodiment, the coupling 202 is configured for sliding movement within socket 204. The extent of the sliding may be defined by the stop 212 and the lug 220 contacting the detent 400. For example, the flexible arm 218 may have a length such that when stop 212 abuts surface 214, the lug 220 is positioned below detent 400. Accordingly, in such an embodiment, when lug 220 is in contact with detent 400, the stop 212 is positioned above and not in contact with surface 214. In one suitable embodiment, the flexible sleeve 522 (FIG. 5) may provide a bias to the shaver head 104 such that the shaver head is extended from the handle (i.e., in a position such that the lugs 220 contact the detents 400) when in rest. When a user applies an axial force to the shaver head 104, the flexible sleeve 522 compresses and the shaver head 104 may move axially toward the handle, for example until the stop 212 abuts the surface 214. As such, the shaver head 104 may also pivot with respect to handle 102, such as if one side, or end, of the coupling 202 is pressed further into the socket 204 than another side thereof (i.e., when a user presses the shaver head against a facial contour). Accordingly, the flexible sleeve 522 may facilitate repositioning the shaver head 104 to the neutral, or rest, position (i.e., fully extended) after the force exerted on the shaver head, causing the pivoting, is removed.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A rotary electric shaver comprising:

a handle assembly including a housing, a socket, a motor disposed in the housing, and a drive shaft operatively connected to the motor, and a shaver head assembly comprising a plurality of cutters and enclosing a space beneath the cutters to define a hair pocket which collects hair cut by the cutters, wherein the shaver head assembly further comprises a coupling situated beneath the hair pocket, the coupling insertable into the socket along an insertion axis of the coupling such that the coupling flexibly engages the handle assembly within the socket at an engagement plane substantially perpendicular to the insertion axis and permits pulling disengagement of the shaver head assembly from the handle assembly.

2. The rotary shaver of claim 1, wherein the cutters include a plurality of inner cutters each operatively coupleable to the drive shaft for rotation therewith, and a plurality of outer cutters each corresponding to a respective one of the inner cutters.

3. The rotary shaver of claim 1, wherein the shaver head assembly is pivotable relative to the handle assembly.

4. The rotary shaver of claim 1, wherein the shaver head assembly comprises a gear housing, a gearset housed within the gear housing, and an intermediate wall separating the hair pocket from the gearset.

5. The rotary shaver of claim 4, wherein the gearset includes a plurality of drive members, the drive members extending through the intermediate wall for rotational engagement with inner ones of the cutters.

6. The rotary shaver of claim 4, wherein the shaver head assembly includes the intermediate wall and a blade carrier on which outer ones of the cutters are supported, the blade carrier situated above the intermediate wall such that an area between the blade carrier and the intermediate wall defines the hair pocket.

7. The rotary shaver of claim 6, wherein the blade carrier is detachable.

8. The rotary shaver of claim 1, wherein the socket has a hexagonal cross section.

9. The rotary shaver of claim 1, wherein the coupling comprises a flexible clip having an engagement surface oriented substantially perpendicular to the insertion axis to flexibly engage the handle assembly within the socket.

10. The rotary shaver of claim 1, wherein the coupling is engageable with the handle assembly within the socket in at least two different orientations of the shaver head assembly relative to the handle assembly.

11. The rotary shaver of claim 1, wherein the coupling comprises a stop defining an extent to which the coupling fits into the socket.

12. A detachable shaver head assembly for a rotary electric shaver, the rotary electric shaver having a handle assembly including a housing, a socket, a motor, and a drive shaft accessible by the shaver head assembly exterior of the housing, the shaver head assembly comprising a plurality of cutters and enclosing a space beneath the cutters to define a hair pocket which collects hair cut by the cutters, wherein the shaver head assembly further comprises a coupling situated beneath the hair pocket, the coupling comprising an insertion axis and a flexible clip having an engagement surface oriented substantially perpendicular to the insertion axis such that, upon insertion of the coupling into the socket along the insertion axis, the clip flexibly engages the handle assembly within the socket at the engagement surface and permits pulling disengagement of the shaver head assembly from the handle assembly.

13. The shaver head assembly of claim 12, wherein the cutters comprise a plurality of inner cutters each operatively coupleable to the drive shaft for rotation therewith, and a plurality of outer cutters each corresponding to a respective one of the inner cutters.

14. The shaver head assembly of claim 12, wherein the shaver head assembly is pivotable relative to the handle assembly.

15. The shaver head assembly of claim 12, wherein the shaver head assembly includes a gearset, a gear housing in which the gearset is housed, and an intermediate wall separating the hair pocket from the gearset.

16. The shaver head assembly of claim 15, wherein the gearset includes a plurality of drive members, the drive members extending through the intermediate wall for rotational engagement with inner ones of the cutters.

17. The shaver head assembly of claim 12, wherein the coupling has a hexagonal cross section.

18. The shaver head assembly of claim 12, wherein the coupling further comprises at least two opposing clips, each of the clips comprising its own engagement surface.

* * * * *